US005816996A

United States Patent [19]

Falbe

[11] Patent Number: 5,816,996

[45] Date of Patent: Oct. 6, 1998

[54] METHOD AND DEVICE FOR MANUFACTURING WRAPPING SHEETS

[75] Inventor: Heinz Falbe, Timrå , Sweden

[73] Assignee: Sunds Defibrator Industries AB, Sweden

[21] Appl. No.: 622,441

[22] Filed: Mar. 25, 1996

[30] Foreign Application Priority Data

Apr. 12, 1995 [SE] Sweden ..... 9501379

[51] Int. Cl.[6] ..... B31F 1/07; B31F 1/36

[52] U.S. Cl. ..... 493/355; 493/401

[58] Field of Search ..... 493/396, 400–403, 493/160, 161, 59, 60, 61, 62, 355; 83/86, 89, 879, 880, 883, 884, 886, 887, 864

[56] References Cited

U.S. PATENT DOCUMENTS

| | | | |
|---|---|---|---|
| 4,931,031 | 6/1990 | Lisiecki | 493/355 |
| 5,417,640 | 5/1995 | Martin | 493/401 |
| 5,529,563 | 6/1996 | Veith | 493/403 |
| 5,626,954 | 5/1997 | Andersen | 428/294.7 |

FOREIGN PATENT DOCUMENTS

| | | |
|---|---|---|
| 0114169 A1 | 8/1984 | European Pat. Off. . |
| 2051717 A | 1/1972 | Germany . |
| 501236 C2 | 12/1994 | Sweden . |
| 88/02306 A1 | 4/1988 | WIPO . |
| 95/10013 A1 | 4/1995 | WIPO . |

*Primary Examiner*—Jack W. Lavinder
*Attorney, Agent, or Firm*—Lerner, David, Littenberg, Krumholz & Mentlik

[57] ABSTRACT

Methods and apparatus for manufacturing wrapping sheets from a pulp web are disclosed. The disclosed method includes drying the pulp web, embossing the dry pulp web by providing a plurality of raised portions on the surface of the dried pulp web, cutting the pulp web into sheets, and forming a stack of sheets of the pulp web. Apparatus for carrying out this method is also disclosed.

6 Claims, 1 Drawing Sheet

METHOD AND DEVICE FOR MANUFACTURING WRAPPING SHEETS

FIELD OF THE INVENTION

The present invention relates to the wrapping of pulp bales. More particularly, the present invention relates to a method and apparatus for manufacturing wrapping sheets for wrapping purposes.

BACKGROUND OF THE INVENTION

After the pulp manufactured in a pulp mill is finished, it is normally dewatered, dried and wrapped so that it can be transported and stored. This applies to pulp mills, which have no papermaking machine of their own or do not consume their entire pulp production. For this purpose, a wet machine is normally used, which comprises a wire portion, a press section, and a drying section. The pulp is thus formed into a web, which in a subsequent slitter and cutter section is cut into sheet form. These sheets are then stacked upon each other and pressed into bales, which are wrapped and wound with tie wire. The wrapping material normally used is large sheets of the pulp web. Such wrapping sheets are produced in suitable sizes by appropriate setting of the cutting machine, whereby a required number of wrapping sheets are obtained and stored in stacks. These stacks of wrapping sheets can then be used in a wrapping machine for the pulp bales. In the wrapping machine, the wrapping sheets are individually removed from the stack and placed both above and below the pulp bale, whereafter the sheets are folded inward to the bale. The binding is then carried out in subsequent binding machines.

In the wrapping machine, problems often arise when the wrapping sheets are to be lifted form the sheet stack. It can, thus, be difficult to separate the sheets, so that instead of one sheet two are lifted, which can cause breakdowns. Several different attempts have been made to ensure that one single sheet is lifted at a time, for example by means of mechanical dollies, vacuum suction, air injection, etc. However, no reliable system has been developed.

It is therefore an object of the present invention to solve these problems in a simple and efficient manner.

SUMMARY OF THE INVENTION

These and other objects have now been accomplished by the invention of a method for manufacturing wrapping sheets comprising providing a pulp web having a first surface and a second surface, drying the pulp web, embossing the dried pulp web by providing a plurality of raised portions on the first surface of the dried pulp web, cutting the pulp web into a plurality of sheets, and forming a stack of the plurality of sheets of the pulp web.

In accordance with one embodiment of the method of the present invention, embossing of the dried pulp web provides the plurality of raised portions over substantially the entire first surface of the dried pulp web.

In accordance with another embodiment of the method of the present invention, embossing of the dried pulp web comprises contacting cooperating embossing rolls on the first and second surfaces of the dried pulp web.

In accordance with another embodiment of the method of the present invention, the method includes synchronizing the embossing and cutting of the pulp web at a predetermined pulp web speed so as to locate the plurality of raised portions on the first surface of the dried pulp web whereby the plurality of raised portions are offset from each other on consecutive sheets upon forming of the stack.

In accordance with the apparatus of the present invention, apparatus is provided for manufacturing wrapping sheets from a pulp web having a first surface comprising a drier for drying the pulp web, an embosser for embossing the dried pulp web to provide a plurality of raised portions on the first surface of the dried pulp web, a cutter for cutting the pulp web into a plurality of sheets, and a stack former for forming a stack of the plurality of sheets of the pulp web.

In accordance with one embodiment of the apparatus of the present invention, the embosser comprising a first embossing roll including a plurality of raised portions thereon and a second embossing roll including a corresponding plurality of recesses thereon.

In accordance with another embodiment of the apparatus of the present invention, the embosser is located subsequent to the drier and prior to the cutter.

BRIEF DESCRIPTION OF THE DRAWINGS

The present invention can be more fully appreciated with reference to the following detailed description which, in turn, refers to a particular embodiment of the present invention and to the Figures herein in which.

DETAILED DESCRIPTION

Figure 1:
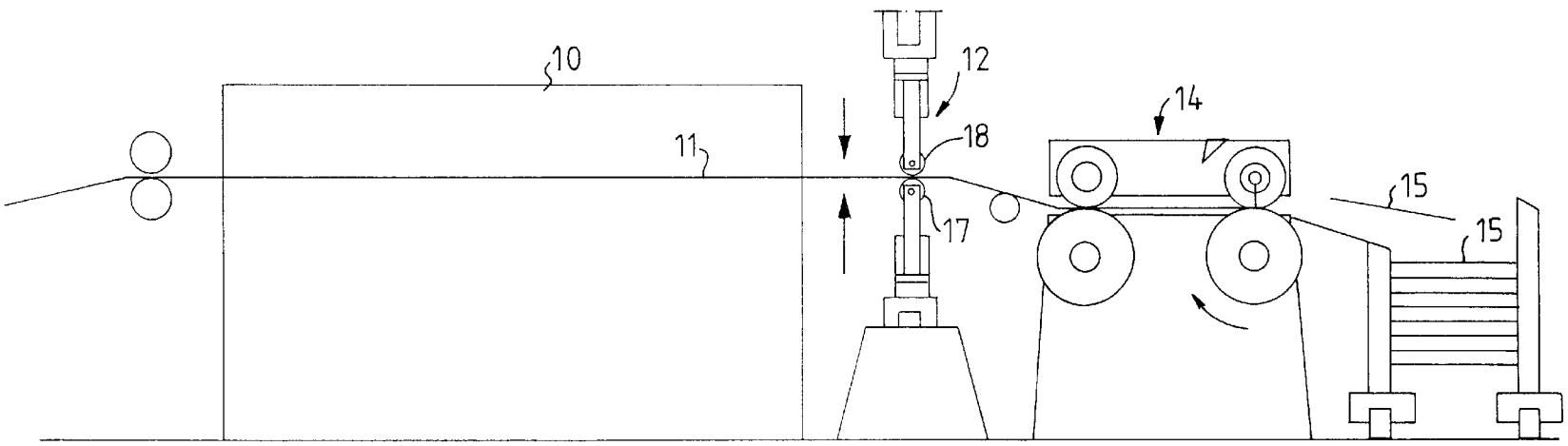
FIG. 1 is a schematic representation of a method and apparatus according to the present invention.
Figure 3:
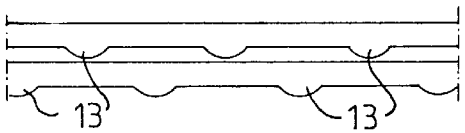
FIG. 3 is a side, elevational, partial view of a pair of stacked wrapping sheets manufactured according to the present invention.
Figure 2:
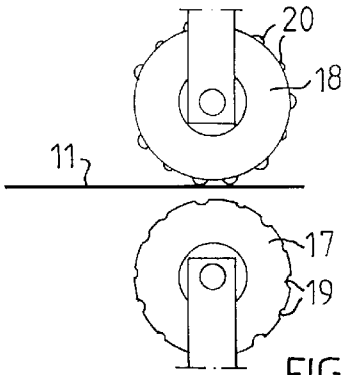
FIG. 2 is a side, elevational, partial view of the embossing members in accordance with the present invention.

Referring to the drawings, in which like reference numerals refer to corresponding elements thereof, the embodiment shown in FIG. 1 comprises a drying machine 10, through which pulp web 11 is fed. Downstream of the drying machine 10, an embossing device 12 is located, which is intended to provide the web 11 with a large number of elevations 13 distributed over the entire web, i.e. profiling of the pulp web.

Downstream of the embossing device 12, a cutting machine 14 is located for cutting the pulp web 11 into sheets 15. A sheet board 16 is located downstream of the cutting machine 14 for receiving the sheets 15 stacked one upon the other.

The profiling or embossing of the pulp web 11 is carried out according to the embodiment shown by means of two rolls, 17 and 18, of which a first roll 17 is provided with recesses 19 and a second roll 18 is provided with corresponding protuberations 20. The rolls, 17 and 18, are pressed against the web by hydraulic cylinders, 21 and 22. Alternatively, the profiling can be carried out in other suitable ways by means of other types of embossing devices, for example by using compressed air or another actuating medium. The profiling is carried out with respect to the drying machine 10 when a dry matter content has been achieved, in the pulp web 11 which is sufficiently high to bring about permanent profiling. This therefore requires that it take place at the end of the drying machine 10 or between the drying machine 10 and the cutting machine 14.

The object of profiling of the pulp web 11, and thereby of the sheets 15 after they have been cut to size, is to facilitate lifting of the sheets individually from the sheet stack in a wrapping machine. The profiling thus prevents the sheets from adhering to each other in the stack.

The appearance of the profiling and the distribution of the elevations 13 over the sheet surface can vary. The height of the elevations can be, for example, between about 1 mm and 5 mm, and the distribution over the surface should be uniform. It is to be observed, however, that these elevations 13 are not located directly on top of each other with respect to consecutive sheets. This can be achieved in different ways, for example, by synchronization of the cutting machine 14, the embossing device 12 and the web speed, so that a displacement of the cutting point in relation to the elevations 13 from one sheet to another is ensured. The diameter of the embossing rolls, 17 and 18, and the division for recesses 19 and protuberations 20, respectively, are to be suitably adapted to the dimensions of the wrapping sheets 15 which are used. The driving of the embossing rolls, 17 and 18, shall be synchronized with the driving of the pulp web.

The invention, in addition to facilitating lifting of the stacked wrapping sheets in the wrapping machine, also offers the advantage that wrapping of the pulp bales themselves is facilitated. The profiling of the wrapping sheets, thus acts as fold indications, so that the sheets can be folded more easily about the pulp bales, i.e. less energy is consumed during the folding process.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

I claim:

1. A method for manufacturing wrapping sheets comprising:

(a) providing a pulp web, said pulp web consisting of a web of wood fibers separated from each other, for later use in papermaking, said pulp having a first surface and a second surface;

(b) drying said pulp web;

(c) embossing said dried pulp web by providing a plurality of raised portions on said first surface of said dried pulp web so that said raised portions are interspersed with unembossed portions;

(d) cutting said pulp web into a plurality of sheets; and (e) forming a stack of said plurality of sheets of said pulp web, whereby said plurality of raised portions facilitates removal of each sheet from said stack.

2. The method of claim 1 wherein said embossing of said dried pulp web provides said plurality of raised portions over substantially said entire first surface of said dried pulp web.

3. The method of claim 1 wherein said embossing of said dried pulp web comprises contacting cooperating embossing rolls on said first and second surfaces of said dried pulp web.

4. The method of claim 1 including synchronizing said embossing and cutting of said dried pulp web at a predetermined pulp web speed so as to locate said plurality of raised portions on said first surface of said dried pulp web whereby said plurality of raised portions are offset from each other on consecutive sheets upon forming of said stack.

5. The method of claim 1 wherein, after said embossing step, said dried pulp web has no embossed features other than said raised portions.

6. The method of claim 1, wherein said step of forming a stack further comprises arranging said sheets such that said raised portions on consecutive sheets are not located directly on top of each other.

* * * * *